US005243333A

United States Patent [19]

Shiba et al.

[11] Patent Number: 5,243,333

[45] Date of Patent: Sep. 7, 1993

[54] DRIVER FOR ACTIVE MATRIX TYPE LIQUID CRYSTAL DISPLAY DEVICE

[75] Inventors: Hiroshi Shiba; Sei Saito, both of Tokyo; Yasuhiro Miyahara, Kanagawa, all of Japan

[73] Assignee: NEC Corporation, Tokyo, Japan

[21] Appl. No.: 921,136

[22] Filed: Jul. 29, 1992

[30] Foreign Application Priority Data

Jul. 29, 1991 [JP] Japan ..... 3-187972

[51] Int. Cl.[5] ..... G09G 3/36

[52] U.S. Cl. ..... 345/100; 307/355; 345/211

[58] Field of Search ..... 340/784, 811; 358/241, 358/236; 307/264, 355

[56] References Cited

U.S. PATENT DOCUMENTS 4,356,483 10/1982 Fujita et al. ..... 340/784 D1
4,760,287 7/1988 Goto et al. ..... 307/355
4,857,906 8/1989 Conner ..... 340/784 D1
5,010,338 4/1991 Miki et al. ..... 307/355
5,066,945 11/1991 Kanno et al. ..... 340/811

*Primary Examiner*—Alvin E. Oberley
*Assistant Examiner*—Gin Goon
*Attorney, Agent, or Firm*—Sughrue, Mion, Zinn, Macpeak & Seas

[57] ABSTRACT

A driver for an active matrix type liquid crystal display device includes a CMOS transfer switch group capable of arbitrarily selecting a drive reference voltage, a CMOS transfer switch for transferring a drive reference voltage selected by the CMOS transfer switch group to a driver output terminal, and an operational amplifier connected in the form of a voltage follower. The liquid crystal driver output voltage quickly reaches an arbitrarily selected drive reference voltage, and a stable voltage coinciding with the reference voltage can be applied to the liquid crystal display device.

5 Claims, 4 Drawing Sheets

PRIOR ART

DRIVER FOR ACTIVE MATRIX TYPE LIQUID CRYSTAL DISPLAY DEVICE

BACKGROUND OF THE INVENTION

1. Field of the Invention

The present invention relates to a driver for a liquid crystal display device and, more particularly, to a driver for selectively applying voltages to pixels of an active matrix type liquid crystal display device.

2. Description of the Prior Art

As a driving system for a matrix liquid crystal display element, an active matrix driving system is widely known.

For a conventional multi-gradation display liquid crystal display device using, e.g., four reference voltages, a liquid crystal driver output circuit, as in FIG. 1, is used. Four reference voltages $V_{R3}$, $V_{R2}$, $V_{R1}$, and $V_{R0}$ are respectively applied to switches SW12, SW13, SW14, and SW15 which are selectively turned on/off and constitute a first stage. Outputs from the adjacent pairs of switches are commonly applied to switches SW16 and SW17 which are alternatively turned on/off and constitute a second stage. Outputs from the switches SW16 and SW17 are commonly applied to an operational amplifier OP2 as a buffer. As a result, the alternatively selected reference voltage $V_{R0}$, $V_{R1}$, $V_{R2}$, or $V_{R3}$ is applied from an output terminal d to a data line of an active matrix type liquid crystal display panel (not shown) and is applied to a pixel electrode in accordance with an ON/OFF operation of a thin-film transistor. The selective ON/OFF operations of the switches SW12 to SW17 are controlled by control signals A and B supplied in the form of digital signals. The control signal A has two values, e.g., 5 V and 0 V. The control signal A is level-shifted to an amplitude of 20 V by a level shifter LS1. At the same time, high- or low-level outputs are obtained from output terminals Q and $\overline{Q}$ of the level shifter LS1 in accordance with the digital value of the control signal A. Two of the four switches SW12 to SW15 are turned on in accordance with the states of the output terminals Q and $\overline{Q}$ of the level shifter LS1. The control signal B is also a binary signal having values of 5 V and 0 V. The control signal B is level-shifted by a level shifter LS2, and outputs corresponding to its digital value are obtained from output terminals Q and $\overline{Q}$. One of the switches SW16 and SW17 is turned on in accordance with the states of the output terminals Q and $\overline{Q}$. Upon control based on the two control signals A and B, one of the four reference voltages $V_{R0}$, $V_{R1}$, $R_{R2}$, and $V_{R3}$ is applied to the operational amplifier OP2 as a buffer.

In such a conventional liquid crystal driver output circuit, since the buffer constituted by the operational amplifier OP2 connected in the form of a voltage follower is used, the power required for liquid crystal driving is supplied from the buffer, and each of the switches SW12 to SW17 can be satisfactorily operated by a small field-effect transistor. For this reason, low-voltage signals can be used to control the switches SW12 to SW17, and no problem is posed in terms of crosstalk among signal lines. This circuit, however, has the following problems.

Since a current constantly flows in the operational amplifier OP2, the power consumption of the circuit is large. In addition, since an output voltage from the operational amplifier OP2 includes an inherent offset voltage, the driver output (voltage) tends to deviate from a selected drive reference voltage. If such a voltage deviation occurs, the display brightness of the liquid crystal panel changes, and a sharp image cannot be obtained.

SUMMARY OF THE INVENTION

It is, therefore, an object of the present invention to provide a driver for a liquid crystal display device, in which an output voltage quickly reaches an arbitrarily selected drive reference voltage so that a stable voltage coinciding with the reference voltage can be applied to the liquid crystal display device.

In order to achieve the above object, according to the present invention, there is provided a driver for a liquid crystal display device, comprising a selection circuit for selecting one of different liquid crystal drive reference voltages, an amplifier, connected between an output terminal of the selection circuit and an output terminal of the driver, for amplifying one drive reference voltage selected by the selection circuit with a gain of "1", switch means connected between the output terminal of the selection circuit and the output terminal of the driver, and control means for rendering the amplifier operative while turning off the switch means, at least in a time interval between the instant at which a selecting operation of the selection circuit is completed and the instant at which an output from the amplifier is stabilized, and rendering the amplifier inoperative while turning off the switch means, after the time interval.

DETAILED DESCRIPTION OF THE PREFERRED EMBODIMENT

An embodiment of the present invention will be described in detail below with reference to the accompanying drawings.

Figure 1:
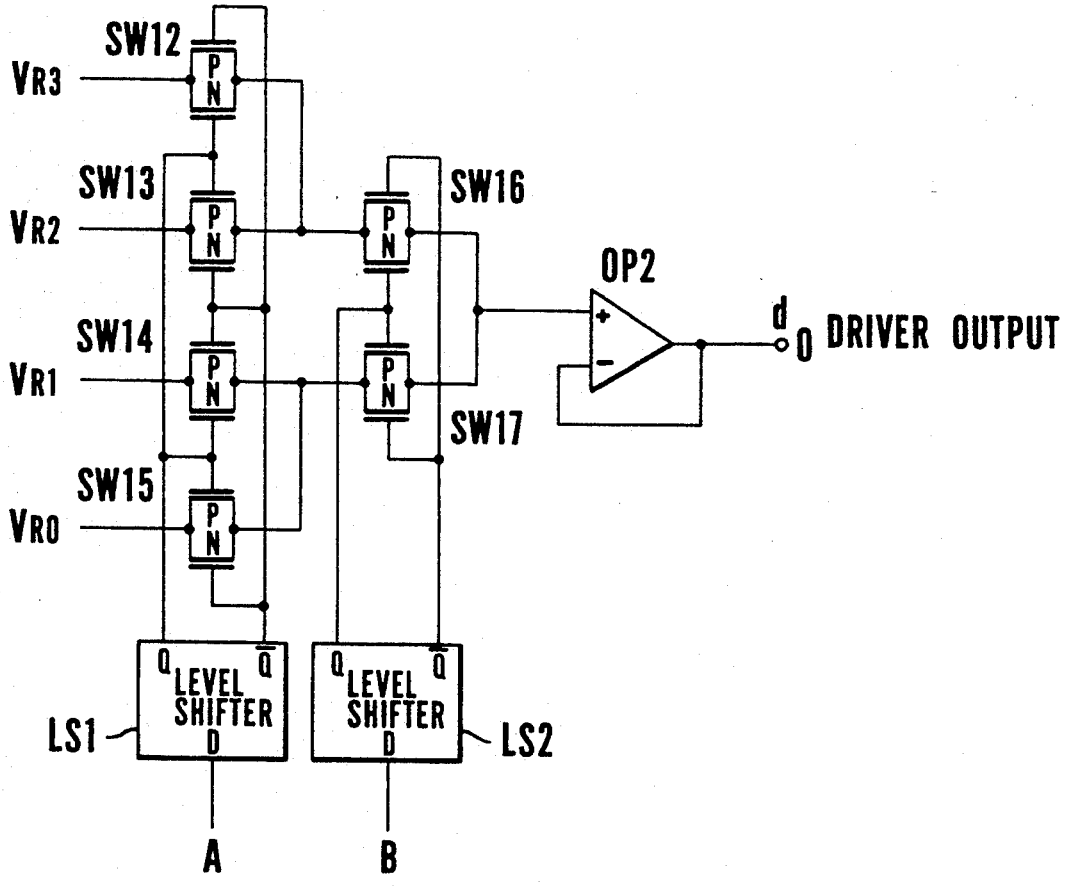
FIG. 1 is a circuit diagram showing an output circuit of a conventional liquid crystal driver.
Figure 2:
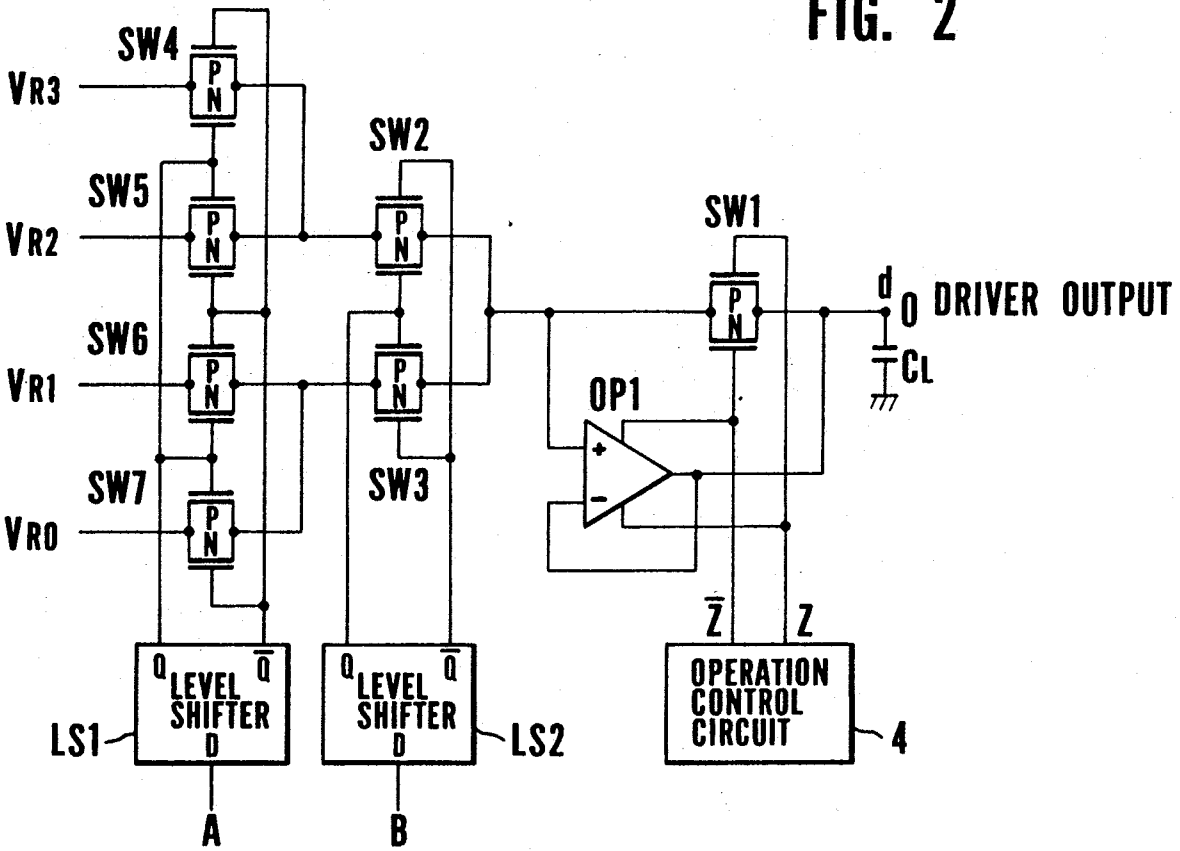
FIG. 2 is a circuit diagram showing a liquid crystal driver output circuit according to an embodiment of the present invention.
Figure 6:
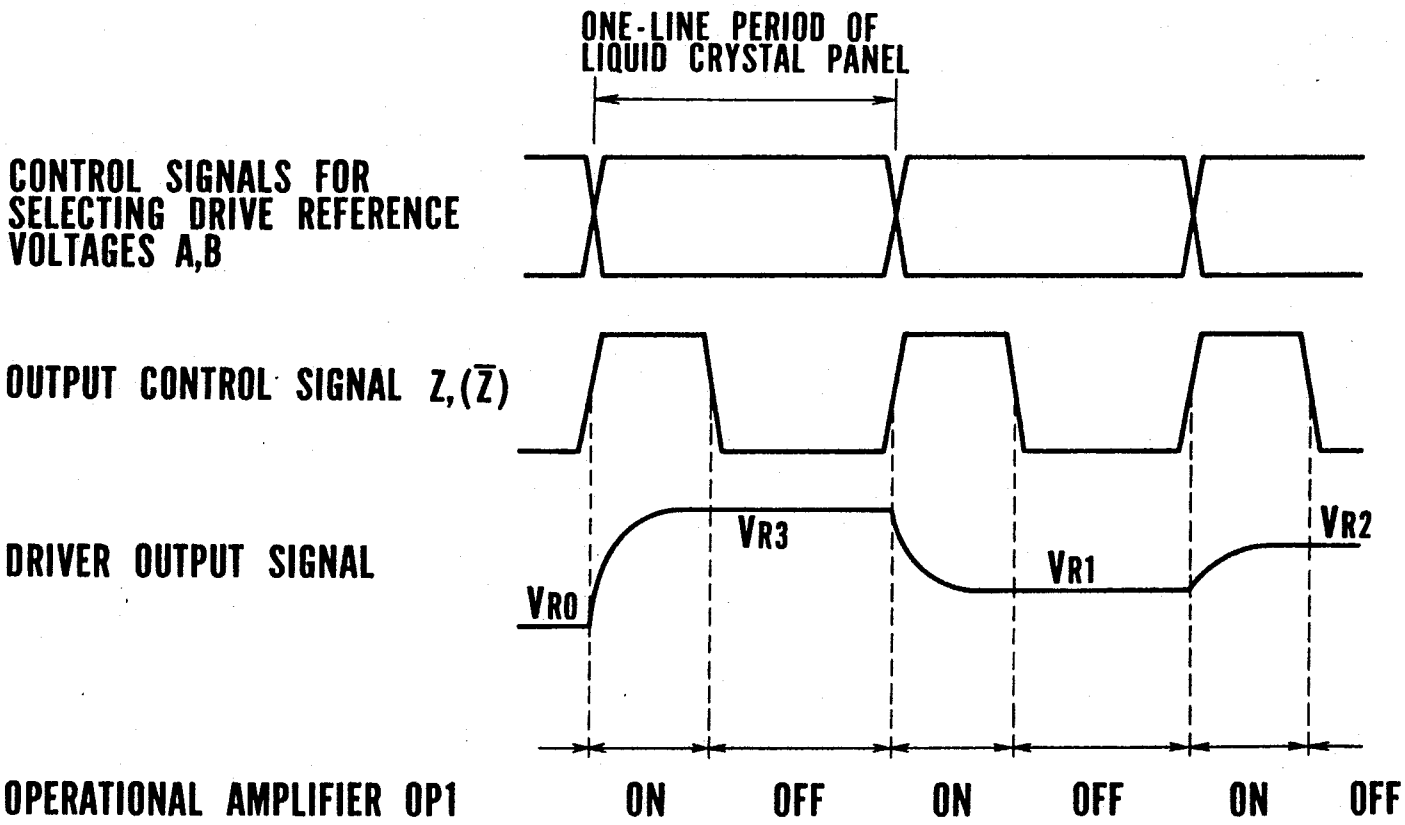
FIG. 6 is a timing chart showing an operation of the embodiment of the present invention.

FIG. 2 is a circuit diagram showing an embodiment of the present invention. FIG. 6 is a timing chart for explaining an operation of the embodiment. This embodiment is a four-gradation-level liquid crystal driver which can change the brightness of each pixel in four levels by selectively using four drive reference voltages $V_{R0}$ to $R_{R3}$.

The respective drive reference voltages $V_{R0}$ to $V_{R3}$ are primarily selected by transfer switches SW7 to SW4, each formed by connecting a p-channel MOSFET P and an n-channel field-effect transistor N in parallel with each other. This primary selection is performed by outputs Q and $\overline{Q}$ from a level shifter LS1 which receives a control signal A for selecting drive reference voltages. As a result, the drive reference voltage $R_{R0}$ or $V_{R1}$ and the drive reference voltage $V_{R2}$ or $V_{R3}$ are selected. The primarily selected drive reference voltages are secondarily selected by transfer switches SW2 and SW3 which are controlled by outputs Q and $\overline{Q}$ from a level shifter LS2 to which a selection control signal B is input. As a result, one drive reference voltage is selected. The selected drive reference voltage is sampled/held by a capacitor $C_L$ through both an operational amplifier OP1 with an operation control terminal, whose detailed circuit diagram is shown, as an example, in FIG. 3, and a transfer switch SW1. Transfer switch SW1 is turned on when the operational amplifier OP1 is deactivated, and turned off when the operational amplifier OP1 is activated. The gain of the operational amplifier OP1 is set to be "1".

The ON/OFF operations of the operational amplifier OP1 and the transfer switch SW1 are controlled by operation control signals Z and $\overline{Z}$ from an operation control circuit 4.

Figure 4:
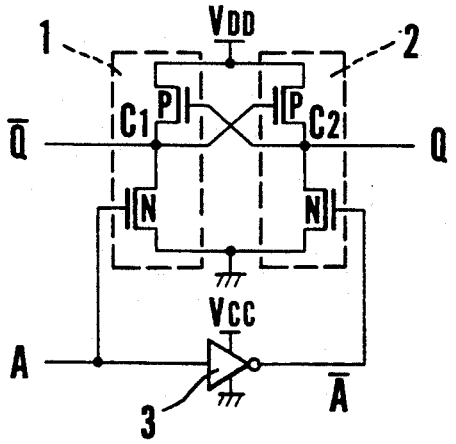
FIG. 4 is a circuit diagram of a level shifter used for the liquid crystal driver output circuit in FIG. 2.

FIG. 4 shows an arrangement of each of the known level shifters LS1 and LS2 used for the liquid crystal driver shown in FIG. 2.

Since the level shifters LS1 and LS2 have the same circuit arrangement, the level shifter LS1 will be described below as a representative. In the level shifter LS1, a pair of C-MOSFETs 1 and 2 and an inverter 3 are connected to each other in the manner shown in FIG. 4, and contact points $C_1$ and $C_2$ between the p-channel FETs and n-channel FETs of the C-MOSFETs 1 and 2 are respectively connected to the gates of the p-channel FETs of the C-MOSFETs located on the opposite sides. Control signals A and $\overline{A}$ are respectively applied to the n-channel FETs of the C-MOSFETs, and the outputs Q and $\overline{Q}$ are obtained from the output terminals at the contact points $C_1$ and $C_2$. A power supply voltage $V_{CC}$ applied to the inverter 3 is set to be, e.g., 5 V, whereas a power supply voltage $V_{DD}$ applied to the level shifter LS1 is set to be, e g., 20 V.

Figure 5:
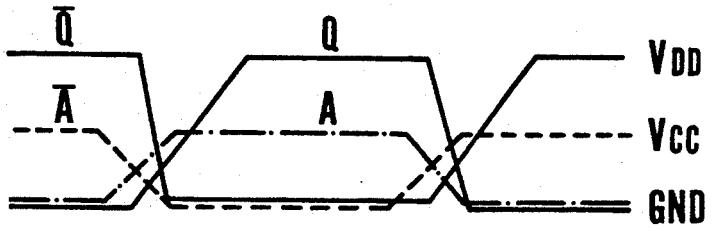
FIG. 5 is a timing chart showing input and output signals to and from the level shifter in FIG. 4.

FIG. 5 shows the relationship between the control signal A supplied to the level shifter LS1 shown in FIG. 4 and the outputs Q and $\overline{Q}$. As shown in FIG. 5, the level shifter LS1 serves to convert an amplitude GND-$V_{CC}$ to an amplitude GND-$V_{DD}$.

Figure 3:
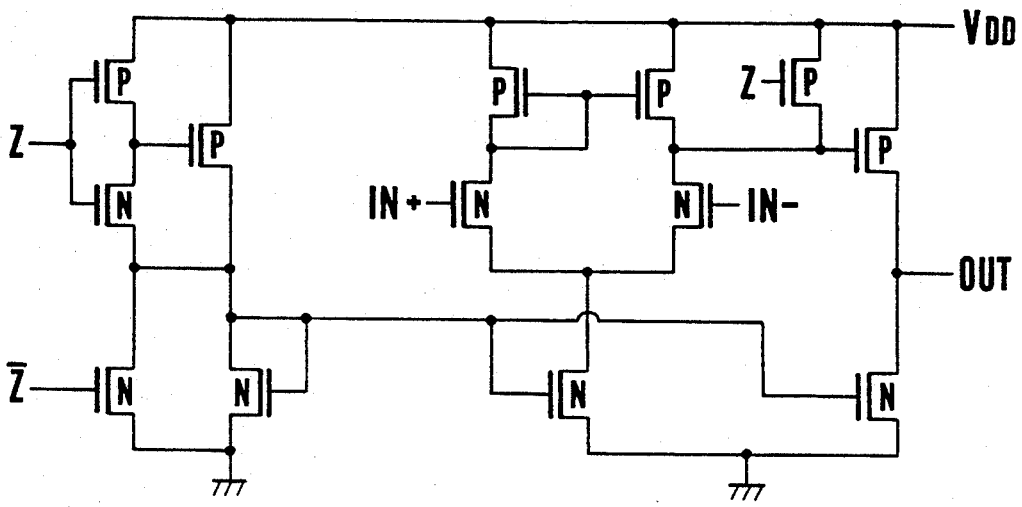
FIG. 3 is a circuit diagram showing an operational amplifier having an operation control function and used for the liquid crystal driver output circuit in FIG. 2.

In the operational amplifier OP1 shown in FIG. 3, reference symbols Z and $\overline{Z}$ denote outputs from the operation control circuit 4; and IN+ and IN−, input signals respectively supplied to the non-inverting and inverting terminals of the operational amplifier OP1. An output signal from the operational amplifier OP1 appears at an output terminal OUT.

An operation of this embodiment will be described next with reference to the timing chart shown in FIG. 6.

Assume that the drive reference voltage $V_{R0}$ is output, as an initial value, from an output terminal d, and that the drive reference voltage $V_{R3}$ is to be applied to the liquid crystal display device. The control signals A and B are set at high level to turn on the switches SW2 and SW4. At the same time, the operational amplifier OP1 is rendered operative by using the operation control signals Z and $\overline{Z}$. With this operation, the load capacitor $C_L$ is quickly charged by an amplifying operation of the operational amplifier OP1, and the voltage at the driver output terminal d quickly reaches the drive reference voltage $V_{R3}$. When the voltage at the driver output terminal d reaches the drive reference voltage $V_{R3}$, the operation control signals Z and $\overline{Z}$ are inverted to render the operational amplifier OP1 inoperative and turn on the transfer switch SW1. With this operation, the potential of the driver output terminal d is forcibly set to be equal to the selected reference voltage $V_{R3}$.

When the drive reference voltage $V_{R1}$ is to be selected next, the control signals A and B are respectively set at high level and low level. When the drive reference voltage $V_{R2}$ is to be selected, the control signals A and B are respectively set at low level and high level. In this case, the operational amplifier OP1 and the transfer switch SW1 are controlled by the operation control signals Z and $\overline{Z}$ in the same manner as described above.

The load capacitor $C_L$ represented as the sum of the capacitance of the liquid crystal display device and the wiring capacitance has a capacitance of about 200 pF for, e.g., a 10-inch panel. In order to drive the capacitor $C_L$ at, e.g., 30 μm or less within one horizontal period, the operational amplifier OP1 is designed to be driven at a sufficiently high speed by a current of about several hundred μA. In this case, even if the operational amplifier OP1 is formed on a silicon substrate, a relatively small area is occupied. In this arrangement, the transfer switches SW1 to SW7 may have relatively large ON resistances (10 kΩ or more). This is because the load capacitor $C_L$ is driven by the operational amplifier OP1 so that the voltage which is set immediately before the switch SW1 is turned on is almost equal to the final voltage set after the switch SW1 is turned on. Consequently, the transfer switches SW1 to SW7 can be formed in small areas. In addition, since the voltage at the driver output terminal d is exactly the same as that selected by the transfer switches SW1 to SW7, the output voltage scarcely varies. Since the operational amplifier OP1 and the transfer switches SW1 to SW7 can be made relatively small, as descried above, a driver output circuit can be formed on a silicon substrate without occupying a large area as in the prior art.

As has been described above, according to the liquid crystal driver output circuit of the present invention, since the output voltage can be quickly set to a preset drive reference voltage by an operational amplifier connected in the form of a voltage follower, the sizes of drive reference voltage selection transfer switches can be minimized. Thus, the driver output circuit of the present invention can be formed in an area ¼ that of the conventional driver output circuit. The effect of this reduction in size is enhanced with an increase in the number of drive reference voltages and the number of driver outputs. In addition, when the output voltage reaches a preset drive reference voltage, the operational amplifier is stopped and the transfer switch for holding the output voltage is operated by operation control signals. For this reason, a reduction in current consumption can be achieved. Furthermore, the problems associated with the voltage difference between driver outputs and the difference between the drive reference voltage and the driver output voltage can be solved. Moreover, since each signal line has good wiring characteristics, no interference is caused between the switches, and variations in drive reference voltage can be eliminated.

What is claimed is:

1. A driver for a liquid crystal display device, comprising:

a selection circuit for selecting one of different liquid crystal drive reference voltages;

an amplifier, connected between an output terminal of said selection circuit and an output terminal of said driver, for amplifying one drive reference voltage selected by said selection circuit with a gain of "1";

switch means connected between the output terminal of said selection circuit and the output terminal of said driver; and control means for rendering said amplifier operative while turning off said switch means, at least during a time interval between the instant at which a selecting operation of said selection circuit is completed and the instant at which an output from said amplifier is stabilized, and rendering said amplifier inoperative while turning on said switch means, after said time interval.

2. A driver according to claim 1, wherein said amplifier is an operational amplifier connected in the form of a voltage follower.

3. A driver according to claim 1, wherein said selection circuit comprises a plurality of C-MOSFETs.

4. A driver according to claim 3, wherein said selection circuit comprises a level shifter for ON/OFF-controlling said plurality of C-MOSFETs.

5. A driver according to claim 1, wherein said switch means comprises one C-MOSFET.

* * * * *